US006267714B1

(12) United States Patent
Wild et al.

(10) Patent No.: US 6,267,714 B1
(45) Date of Patent: Jul. 31, 2001

(54) BAG-PRODUCING APPARATUS AND METHOD OF PRODUCING FOIL BAGS

(75) Inventors: Hans-Peter Wild, Zug (CH); Eberhard Kraft, Neckarbischofsheim (DE)

(73) Assignee: INDAG GmbH & Co. Betriebs-KG, Eppelheim/Heidelberg (DE)

( * ) Notice: Subject to any disclaimer, the term of this patent is extended or adjusted under 35 U.S.C. 154(b) by 0 days.

(21) Appl. No.: 09/317,001

(22) Filed: May 24, 1999

(30) Foreign Application Priority Data

Jun. 3, 1998 (DE) ..... 198 24 797

(51) Int. Cl.[7] ..... B31B 1/00; B31B 1/04

(52) U.S. Cl. ..... 493/11; 493/37; 493/189; 493/200; 493/374

(58) Field of Search ..... 493/10, 11, 12, 493/22, 37, 189, 193, 194, 210, 200, 374, 379, 29, 24, 196, 195, 201, 199

(56) References Cited

U.S. PATENT DOCUMENTS

| | | | | |
|---|---|---|---|---|
| 4,869,048 | * | 9/1989 | Boeckmann | 53/451 |
| 5,417,639 | * | 5/1995 | Cronauer | 493/223 |
| 5,470,300 | * | 11/1995 | Terranova | 493/11 |
| 5,868,658 | * | 2/1999 | Wild | 493/212 |

FOREIGN PATENT DOCUMENTS

| | | |
|---|---|---|
| 368973 | 11/1982 | (AT) . |
| 2236524 | 2/1974 | (DE) . |
| 2442610 A1 | 3/1976 | (DE) . |
| 2534306A1 | 7/1976 | (DE) . |
| 2513776 A1 | 10/1976 | (DE) . |
| 2700971A1 | 8/1977 | (DE) . |
| 3425430A1 | 1/1986 | (DE) . |
| 3631940 A1 | 4/1987 | (DE) . |
| 3727339A1 | 3/1989 | (DE) . |
| 4114255 A1 | 4/1992 | (DE) . |
| 4225061 A1 | 3/1993 | (DE) . |
| 4446104 A1 | 7/1996 | (DE) . |
| 19502830A1 | 8/1996 | (DE) . |
| 29521183U1 | 11/1996 | (DE) . |
| 4446104 C2 | 4/1997 | (DE) . |
| WO91/18797 | 12/1991 | (WO) . |

* cited by examiner

*Primary Examiner*—Ira S. Lazarus
*Assistant Examiner*—Hemant M. Desai
(74) *Attorney, Agent, or Firm*—Seed IP Law Group PLLC

(57) ABSTRACT

The present invention relates to a method of producing foil bags, wherein at least two foils are supplied that serve as side foils of the foil bags, the foils are connected to each other and then cut into individual foil bags, wherein possibly existing differences in the amounts of foil materials provided by the at least two foils in the feed direction for a respective foil bag are eliminated by stretching the foil that provides the smaller amount of foil material for a foil bag, and to a bag-producing apparatus for performing the method.

18 Claims, 3 Drawing Sheets

BAG-PRODUCING APPARATUS AND METHOD OF PRODUCING FOIL BAGS

CROSS-REFERENCE TO RELATED APPLICATIONS.

This application claims priority from German Patent Application No. 198 24 797.4, filed Jun. 3, 1998.

FIELD OF INVENTION

The present invention relates to a method of producing foil bags, wherein at least two foils, which serve as side foils of the foil bags, are placed one upon the other and are connected to each other and cut into individual foils bags, and to a bag-producing apparatus for performing the method.

BACKGROUND OF THE INVENTION

In a foil-bag producing process, at least two foils are supplied that serve as side foils of the foil bag. The foils are normally supplied by corresponding supply rolls. The individual foils are placed one upon the other and are sealed or bonded to each other at least at the place where the side edges of the foil bags are positioned. The interconnected foil webs are then cut along the connections to form individual foil bags. A bottom foil which in the area of the future bottom of the foil bag is sealed or bonded between the side foils and provides space for the filling material when being folded apart can be placed between the side foils. Moreover, such a bottom foil functions as a standing base. Subsequently, the foil bags which are produced in this way and are closed at three side edges can e.g. be supplied to a filling station in which the filling material is filled in through the fourth edge that has not been closed yet, and this fourth edge of the two side foils is then sealed or bonded.

As a rule, the foil webs which are supplied to the sealing means are already provided with corresponding imprints which furnish information about the product to be contained in the foil bag. For instance, it is exactly determined for each individual foil web already before it is supplied to the sealing or bonding means how much foil material is respectively provided for a foil bag. However, there might be slight variations in the amount of foil material intended for a foil bag. Such variations may e.g. be caused by an unprecise printing machine for forming the imprint. Moreover, the unwinding operation which is carried out on the supply roll might lead to different extensions of the foil material, depending on whether a great or small amount of foil material has been wound onto the supply roll. In view of the large outputs which are nowadays standard in automated production systems, such variations, even though they are small as such, accumulate in an additive manner, possibly resulting in an undesired displacement of the printed pattern relative to the side edges of the future foil bag. Such a problem will be all the more serious if, in addition to the imprint, there are other features provided for, e.g. an insertion hole for a straw in a foil bag for beverages where the straw is displaced with respect to its correct position.

SUMMARY OF THE INVENTION

It is therefore the object of the present invention to provide a method and an apparatus in which variations in the amount of the foil material intended for the individual sides of the foil bag are avoided.

In the method according to the invention, at least two foil webs are first of all supplied for forming the side foils of the foil bags. The foils are placed one upon the other and connected to each other at the future side edges of the foil bags. Possibly existing differences in the amounts of foil materials as are provided by the at least two foils in the feed direction for a respective foil bag are eliminated by stretching the foil that provides the smaller amount of foil material for a foil bag.

As a consequence, a step is taken in the method prior to the bonding or sealing process for compensating for possibly differing amounts of foil materials. It is thereby ensured that the individual foil webs come to rest one upon the other in the correct position before they are connected to each other. A displacement, even a slight one, can thereby be prevented, so that the accumulation of incorrect positions is avoided. Since the foil which in actual fact provides the smaller amount of foil for a foil bag in the feed direction is the only one that is subjected to a stretching operation, the method will react to every change in condition.

The stretching operation can easily be carried out when the foil supply of the foil to be stretched is interrupted or slowed down for a short period of time while the discharge operation following the connecting process is continued. As a result, the foil supply is controlled in response to the necessary stretching operation. The foil supply can e.g. be interrupted by clip means which act upon the supplied foil whenever said foil is to be stretched.

In another development of the method the stretching operation is performed by holding the foil to be stretched at two spaced-apart places and by simultaneously increasing the foil tension between the holding points. This method permits a very precise stretching of the foil. In this development the foil may be firmly clamped at the holding points, so that the stretching operation is carried out in the foil section between the holding points.

The foil tension can easily be increased with the help of a stretching body which deflects the foil to be stretched laterally from the unaffected transportation path over the entire width between the two holding points. As a result of the lateral deflection, the foil web is stretched.

The question which one of the stretching means is presently the active one on the at least two supplied foils depends on the question which one of the foil webs is to be stretched. This operation may be carried out automatically or, however, in a manually controlled manner. Whenever the amounts of foil materials provided by the at least two foils in the feed direction for a respective foil bag are approximately identical for the two foils, it may be of advantage when one of the foils is permanently prestretched, for instance, by being supplied at a lower speed. The other foil is then stretched in a corresponding manner according to the method of the invention.

There are various possibilities of detecting the amount of foil material provided for a foil bag in the feed direction. In a particularly advantageous development of the method, the supplied foil has provided thereon respective marks which are applied to the foil material at distances corresponding to the amount of foil material respectively provided for a foil bag. It can easily be determined by measuring the distance of said marks how much foil material is provided in the respective foil for a foil bag. Whenever the distance between the individual marks is smaller than the extension a future foil bag should have in the feed direction, said foil material will be stretched accordingly until the respective marks have the desired distance.

The marks may be formed by notches, holes or structural features. However, a mark which can be sensed optically represents a simple configuration. Such a mark can easily be printed in advance onto the foil material to be supplied, e.g. in the process in which the inscription on the future foil is applied to the foil. An additional process step is not needed for this purpose. In addition, optical marks can very easily be detected and evaluated.

Such marks can be applied in an area of the supplied foil material which is cut off prior to the final formation of the foil bag. A particularly economic variant will however be achieved when the mark is provided in an area which will later form the side foil of a respective foil bag. In such a case foil material need not be wasted for removing the mark. A mark which can be read out optically may thus be very small and can consequently be formed in an unobtrusive manner. Moreover, the optical mark can be integrated into the imprint of the foil that exists at any rate, or part of the existing imprint itself can be used as the optical mark.

The method can be performed on foil webs having a width in a direction perpendicular to the feed direction, the width exactly corresponding to one foil bag. The method, however, can be used in a particularly efficient manner when the supplied foil material has a width corresponding to a plurality of foil bags, so that a plurality of foil bags can be subjected to the individual production steps side by side and at the same time. The foil bags which are thus produced side by side are then separated from each other in a subsequent process. When such a parallel method is used, an individual mark which is valid for a series of parallel-produced foil bags is sufficient.

The bag-producing apparatus according to the invention for performing the method of the invention comprises a measuring means for sensing the amount of foil material of the respectively supplied foils, which material is provided in the feed direction for producing a respective foil bag. Furthermore, the bag-producing apparatus of the invention comprises a stretching means for every foil supplied, the means being designed such that it stretches the repective foil in response to a signal from the measuring means.

Advantageously, there are provided several optical sensors for sensing marks on the supplied foil, whereby it is possible to determine the amount of foil that is provided by the individual foils for forming an individual foil bag. Such optical sensors readily permit a precise measurement. The signal of the optical sensors can directly be used for initiating a corresponding stretching operation by the stretching means.

Whenever foils are processed whose extension in a direction perpendicular to the feed direction corresponds to a plurality of foil bags, a single sensor along the width of the supplied foil is sufficient for determining the amount of foil material which is provided by the respective foil for producing a foil bag.

Differences in the feeding speed of the individual foil materials can also be compensated by the stretching means. Advantageously, however, these are compensated with the aid of tensioning means which apply a constant tension to the foil upstream of the stretching means. This is conducive to a precise foil supply.

In a preferred embodiment of both the method and the apparatus, a sealing operation is carried out, providing a connecting mechanism for the individual foils. In the bag-producing apparatus of the invention, a sealing means is here provided downstream of the stretching means.

DESCRIPTION OF THE DRAWINGS

A development of the method according to the invention will now be explained with reference to an embodiment of the bag-producing apparatus of the invention with reference to the attached figures, in which.

DETAILED DESCRIPTION OF THE ILLUSTRATED EMBODIMENTS

Figure 3:
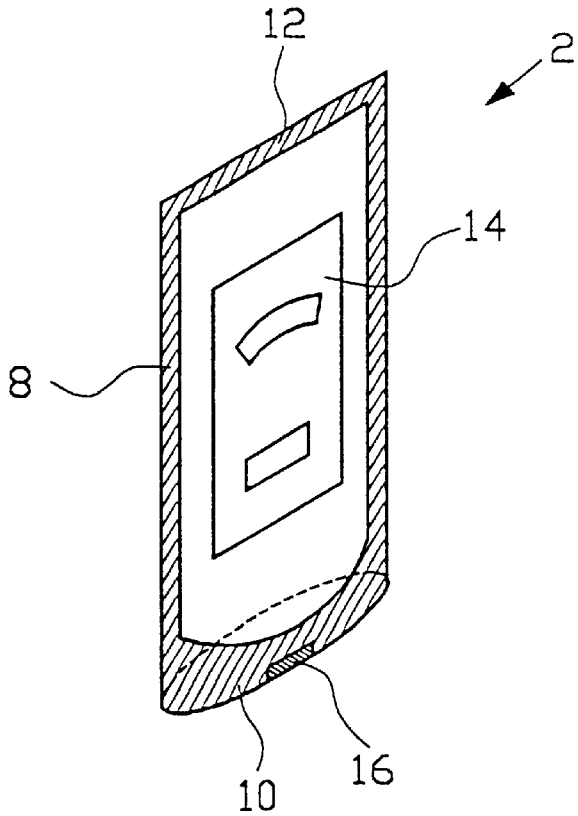
FIG. 3 shows a finished foil bag.

FIG. 3 shows a finished foil bag, as is e.g. intended for receiving beverages. The foil bag 2 consists of two side foils which are welded or sealed to each other along the side edges 8. In the illustrated example, a bottom foil is sealed in the bottom area 10. After the bottom foil has been folded apart, the foil bag 2 has thus an extension which provides room for the filling material, e.g. the beverage. After the filling process, the foil bag is sealed at the upper edge 12 to be closed. Imprints 14 which furnish information about the contents of the foil bag are e.g. provided on the side foils. In the illustrated example of a foil bag a mark 16 is provided near the lower edge of the respective side foils. The material of the foil bag may e.g. be laminated aluminum foil.

Figure 1:
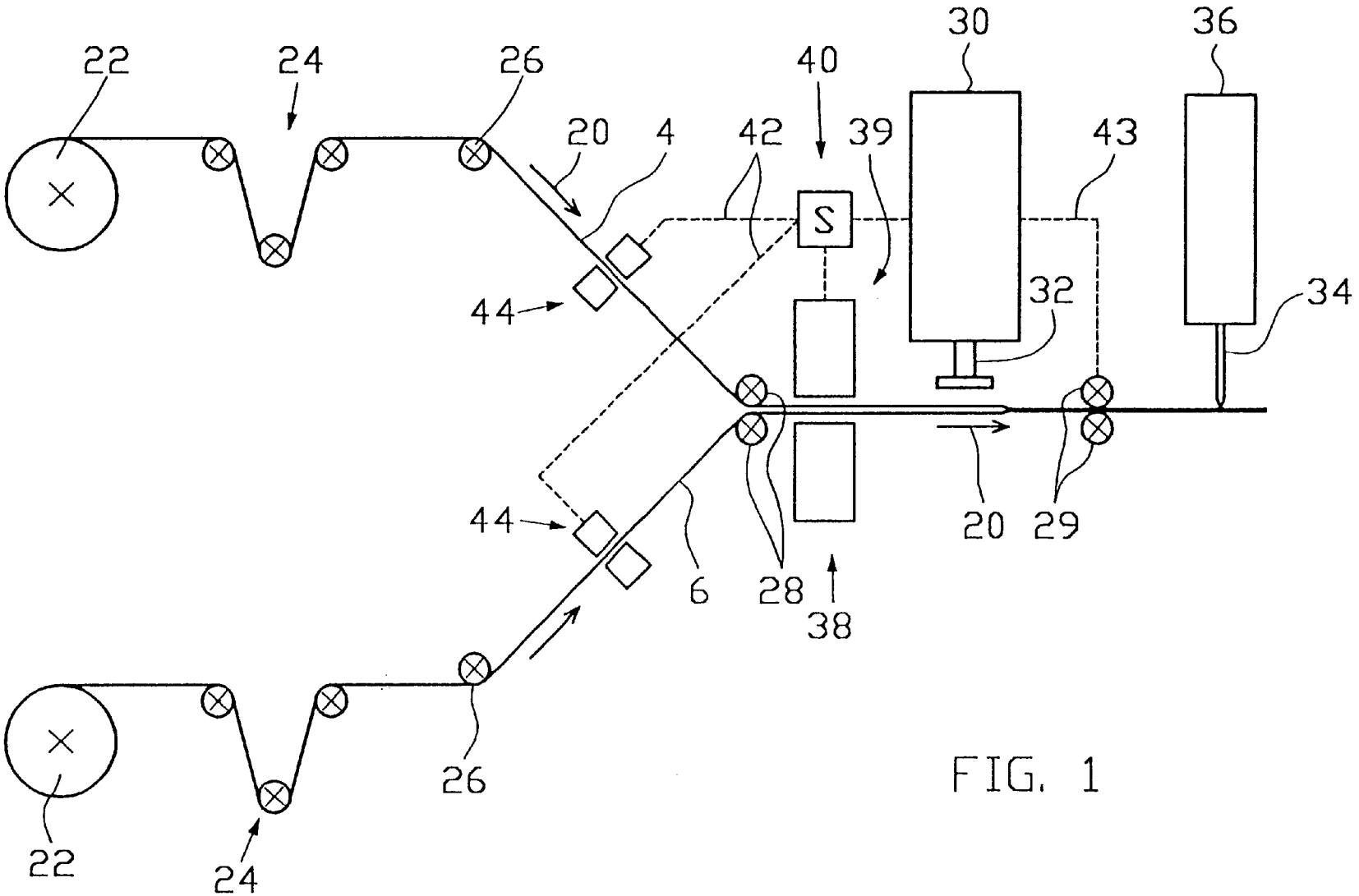
FIG. 1 is a schematic side view of a bag-producing apparatus according to the invention.

In FIG. 1, 22 designates supply rolls which have wound thereonto foil webs for forming the side foils. Imprint 14 is already provided on the side foils for the individual foils. The supply of the bottom foil is not shown for the sake of clarity. The individual foils 4, 6 are e.g. guided through spring-biased tensioning means 24, which are known per se, and around the deflection rolls 26 and 28. 29 designates a withdrawal means for the interconnected foils, e.g. rotating rollers which convey the sealed foils in direction 20 by frictional grip. 32 designates the sealing head of a sealing means 30, and 34 designates the knife of a cutting means 36 which extends over the width of the foil.

38, 39 designate a measuring means which is e.g. formed by two optical sensors 38, 39 which are arranged above and below the united foil web to detect the marks provided thereon. The optical measuring means is connected to a control unit 40 which, in turn, is coupled via signal lines 42 to clip means 44 which can act upon the foil webs supplied.

Figure 2:
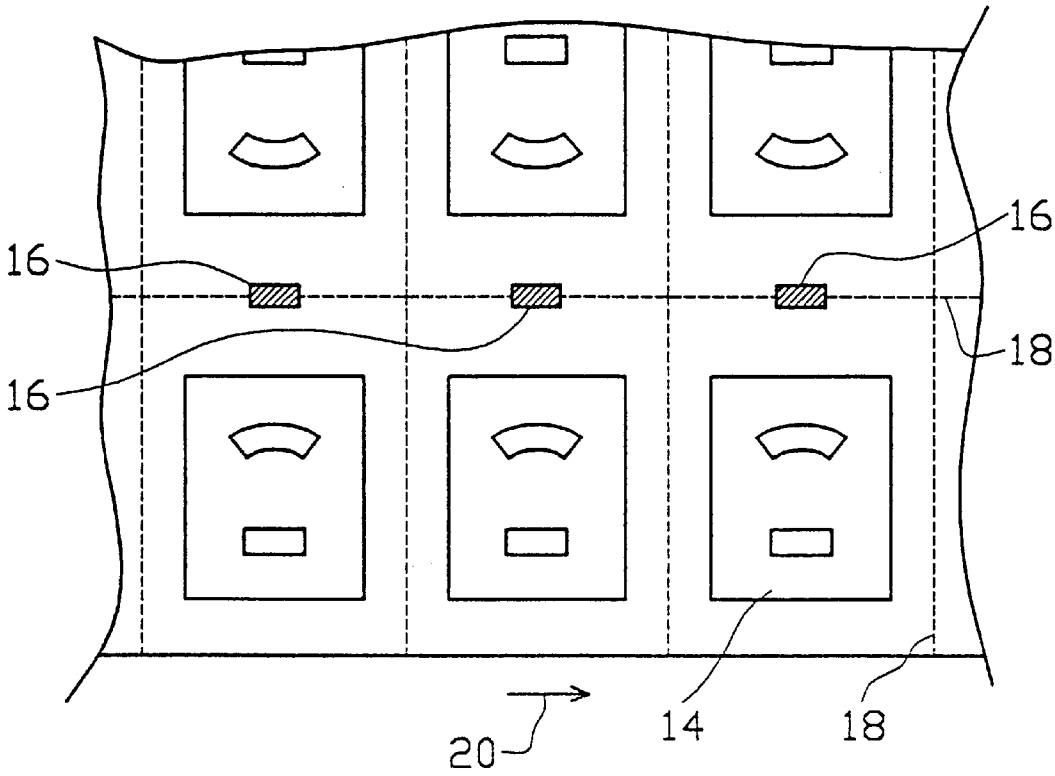
FIG. 2 shows a section of a foil web before it is supplied to the connecting means.
Figure 4A:
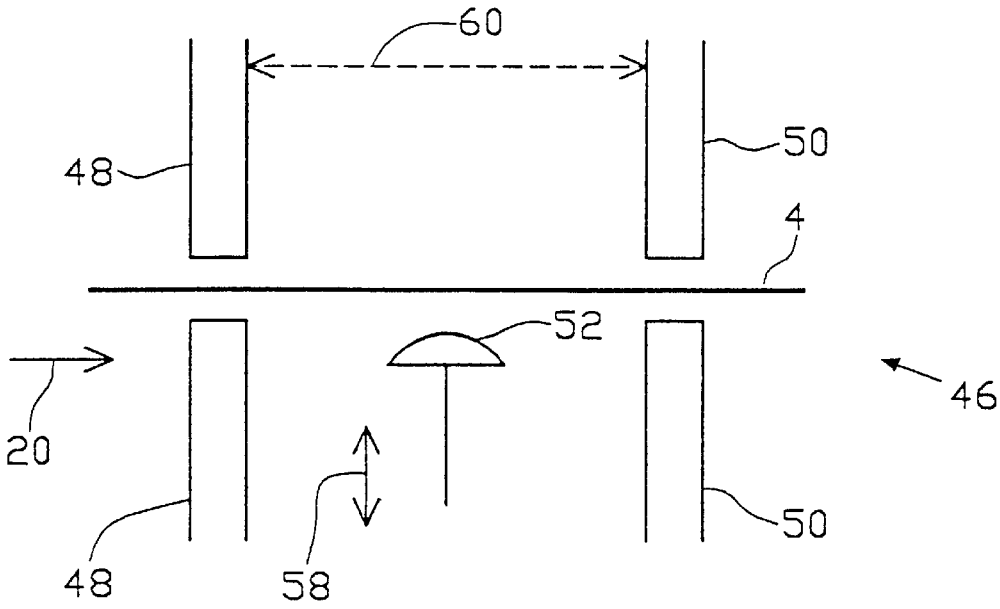
FIGS. 4*a* and 4*b* show a stretching means of another embodiment of the apparatus according to the invention.
Figure 4B:
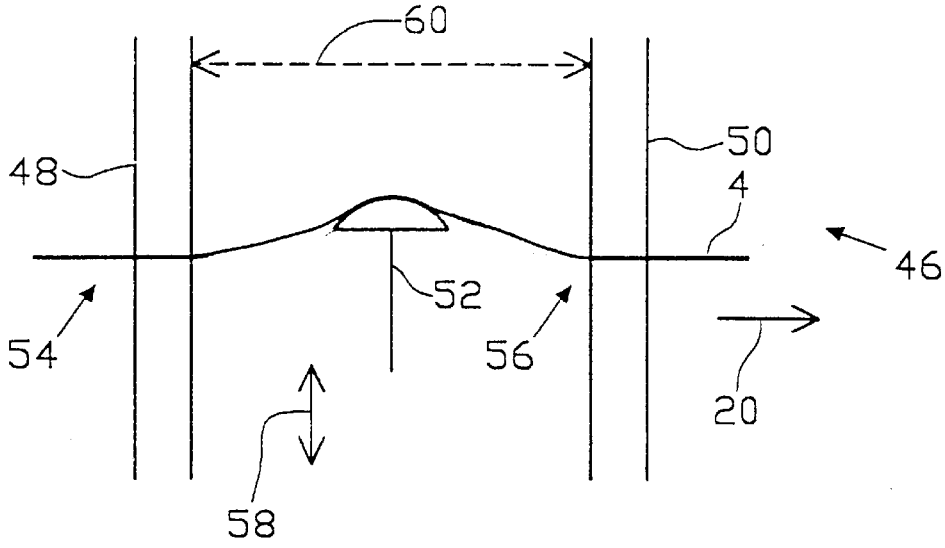

FIG. 2 shows a section of a supplied foil. The running direction of the foil web is again designated by 20. 18 designates the cutting edges along which the cutting means 36 is to cut the foil web into individual foil bags. In the illustrated embodiment, marks 16 are provided along such a future cutting edge. They have already been printed together with the imprints 14 for the individual foil bags onto the foil which is withdrawn from the supply roll 20. In the illustrated embodiment two foils bags are simultaneously processed in a direction perpendicular to the running direction. FIGS. 4*a* and 4*b* show a stretching device 46 which in another embodiment of the inventive apparatus is used instead of the clip means 44. 4 designates a foil web which must be stretched. Holding means 48 and 50 are provided at a distance 60 in the feed direction 20 of the foil. The holding means are e.g. clips which can be moved towards each other in a direction perpendicular to the direction of transportation 20 of the foil. A stretching body 52 is arranged in the form of a piston, which is movable in direction 58, in such a manner that the body can move towards the foil 4 in direction 58. Hence, the stretching body 52 extends over the entire width of the foil material 4.

The method of the invention is carried out with the first-described embodiment of the apparatus according to the invention as follows:

Foil webs, as are shown as a section in FIG. 2, are unwound from the foil rolls 22, e.g., by applying a tractive force which is exerted by the discharge means 29 on the foil web, for instance, by a frictional grip of corresponding conveying rollers. The discharge speed is kept constant at the place of the discharge rollers 29. The respective foil webs 4, 6 are acted upon by a tensioning means 24 with a substantially constant tension before being united by deflection rolls 26 and 28. In the illustration of FIG. 1, imprints 14 as are shown in FIG. 2 are provided on the upper foil web 4 at the upwardly oriented side. By analogy, in the illustration of FIG. 1, identical or different imprints are provided on the lower foil web 6 at the downwardly oriented side. After the foil webs 4 and 6 have been united by the deflection roll 28, they pass through the optical measuring means 38, 39. 39 detects the individual marks on the upper foil web whereas 38 detects the marks on the lower foil web. Corresponding signals from said optical measuring means 38, 39 are passed onto the control unit 40 which on the basis of the speed of the discharge means 29, which is transmitted to the control unit 40 via the signal line 43, calculates the distance of the individual marks 16 for both the upper and lower foil webs 4 and 6.

If the measurement of the measuring means 38, 39 reveals a difference in the distances of the individual marks from one foil web 4 to the other foil web 6, the control unit 40 supplies a signal to the clip 44 which is assigned to the foil web on which the marks 16 have a smaller distance than on the other foil web. The corresponding clip 44 acts upon the corresponding foil web for a short period of time. Since the discharge speed of the discharge rollers 29 remains constant, the shorter foil is thus stretched while the other foil is not subjected to any stretching operation. The clip 44 which has received the signal from the control unit 40 will remain closed until the difference in the distances of the marks 16 on the respective foil webs has been eliminated.

In contrast to the above-described embodiment, the control unit 40 can also compare the measured distance of the individual marks 16 in the feed direction with a predetermined desired distance. A comparison of the individual distances on the two differing foils becomes thereby superfluous.

In an embodiment of the apparatus according to the invention, which comprises a stretching means 46 according to FIGS. 4*a* and b, the stretching operation is carried out as follows: Whenever one of the measuring means 38, 39 detects that a foil must be stretched, a signal is transmitted to the stretching means 46. The holding means 48, 50 move towards the foils 4, 6, holding the same at a distance 60. At the same time, the plunger 52 moves in direction 58 towards the foil, thereby laterally moving the foil out of its original position. This effects a stretching operation only in the area between the holding means 48, 50, whereby a difference in the length of the foils is eliminated.

After the amount of foil material as provided by the individual foils 4, 6 for a foil bag in the feed direction has been compensated by a corresponding stretching operation, the united foil webs 4, 6 are supplied to the sealing means 30. The sealing head 32 is designed such that while being lowered onto the united foils 4, 6, it seals the foils to each other along the future side edges 8 and the bottom portion 10. This operation is carried out by correspondingly shaped heating portions provided on the sealing head 32 in a manner which is known per se. After the sealing operation, the sealing head 32 is lifted again and the foil webs which have been sealed together are supplied to the cutting means 36. The sealed foil web is cut with the help of a knife 34 along the edges 18 to form individual foil bags.

The whole bag-producing apparatus is normally operated intermittently at a rate corresponding to the width of a foil bag in the feed direction of the foil material. In talking about a constant speed of the discharge roller 29 in the former embodiments, reference has been made to the fact that there is a constant rate and that the speed is kept constant during the individual intervals or rates.

Deviating from the above embodiment, the supply rollers 22 can also be driven by a motor. When the supply of a foil is stopped by the foil being acted upon by the corresponding clip means 44, 46, or when the foil is stretched, the foil material which is unwound from the supply roll 22 during this period is nevertheless kept under a constant tension by the tensioning device 24.

In the illustrated embodiment a mark 16 is provided for a plurality of foil bags which are simultaneously processed in a direction perpendicular to the feed direction 20 of the foil materials 4, 6. Consequently, only one optical sensor 38 or one optical sensor 39, respectively, is required along the width of the foil material. Whenever foil material having several marks is to be processed along the width of the foil material, a corresponding number of optical sensors must be provided along the width.

The imprint which furnishes information about the contents of the foil bag can directly be used as a mark in that corresponding characteristic features, such as corners or edges in the picture, are evaluated by the measuring means. As a consequence, an additional mark 16 can entirely be dispensed with.

A special case may arise when the amount of foil material provided by the individual foil webs for a respective foil bag is substantially the same. This could lead to a situation where the machine would constantly switch between the clip means of the individual foil webs 4, 6. In such a case it might be useful when one of the two foil webs is permanently prestretched. The correspondingly other foil web is then stretched in the above-described manner by the stretching means assigned to said foil web and is adapted to the permanently prestretched foil web.

A permanent extension can e.g. be achieved by operating the motor of the corresponding supply roll at a lower speed. Another possibility consists in providing the tensioning means 24 of the corresponding foil web with a greater bias. Finally, it is easily possible to use the stretching means of the foil to be permanently prestretched for prestretching purposes. In such a case, the corresponding clip means 40, 48, 42 are used for slowing down the corresponding foil material in that the clip means do not stop the foil transportation entirely.

When more than two foil webs are used, a corresponding stretching mechanism may be provided for each supply.

It is guaranteed by the method of the invention and the apparatus of the invention that the amount of foil material which is provided by the individual foil webs 4, 6 for one foil bag in the feed direction remains constant. Accuracies in the order of $\mu$m can be achieved with the apparatus of the invention. It is thereby ensured—even at great throughput rates and speeds—that the individual foils are placed in the correct position one upon the other and that there is no displacement of the pattern or other features of the foil bag.

What is claimed is:

1. A method of producing foil bags wherein at least two foils are supplied that serve as side foils of the foil bag, the foils are placed one upon the other and are connected to each other at at least a pair of future side edges of the foil bag, and the foils interconnected in this way are discharged and cut to form individual foil bags, and wherein differences in the amounts of foil materials respectively provided by the at least two foils in a feed direction for a respective foil bag are eliminated by stretching the foil that provides a smaller amount of foil material for a foil bag than the other foils, the stretching being accomplished by holding the foil to be stretched for a short period of time at at least two holding points, and by simultaneously increasing the foil tension between the at least two holding points.

2. The method according to claim 1 wherein the foil tension is increased with the help of a stretching body which deflects the foil to be stretched over the foil's entire width.

3. The method according to one of claims 1 or 2, wherein, in a direction perpendicular to the feed direction, the foil materials have at least a width corresponding to a plurality of foil bags, and a plurality of foil bags are simultaneously produced in a row from said foil materials.

4. The method according to claim 1 wherein the amount of foil material provided by a foil for a respective foil bag is detected with the aid of marks on the foil material spaced apart at distances corresponding to the amount of foil material provided for a respective foil bag.

5. The method according to claim 4 wherein only one mark is provided for a row.

6. The method according to claim 4 wherein the marks are optically sensed.

7. The method according to claim 4 wherein the marks are printed onto the foils.

8. The method according to claim 7 wherein the marks are applied in an area of the foils which becomes part of the side foils of a foil bag.

9. The method according to claim 7 wherein parts of an informative imprint are used as marks.

10. The method according to claim 1 wherein the individual foils are sealed to one another along the future side edges of the foil bag during the connecting process.

11. The method according to claim 1 wherein one of the at least two foils is permanently prestretched, and the other foil(s) is/are adapted by being correspondingly stretched.

12. A bag-producing apparatus comprising at least one first and second foil feed means, a means for connecting the individual foils, a discharge means for discharging the connected foils, a cutting means for cutting the connected foils into individual foil bags, a measuring means for sensing the amount of foil material provided for producing a foil bag, and a respective stretching means for each of the at least two foils supplied, which stretching means is configured to stretch the respective foil in response to a signal from the measuring means, the stretching means incorporating at least two clip means that are spaced apart in a transportation direction of the foil, the clip means being designed to act upon the supplied foil at at least two spaced-apart holding points, as well as a stretching mechanism designed to deflect the supplied foil the entire foil width between the holding points.

13. The apparatus according to claim 12 wherein the measuring means comprises a number of optical sensors for sensing marks on the foils.

14. The apparatus according to claim 12 wherein the stretching mechanism comprises a plunger which is moveable in a direction perpendicular to the transportation direction and extends over the entire foil width.

15. The apparatus according to claim 12, further comprising an extension provided in a direction perpendicular to a feed direction of the foils, which is sufficient to process foils whose width corresponds to a plurality of foil bags.

16. The apparatus according to claim 15 wherein for each foil supplied, there is provided only one sensor along the width of the supplied foil for detecting the amount of foil material provided by the individual foils for producing a foil bag.

17. The apparatus according to claim 12, further comprising tensioning means for maintaining the tension of the supplied foils.

18. The apparatus according to claim 12 wherein the means for connecting the individual foils comprises a sealing means.

* * * * *